US012345184B2

(12) United States Patent
Ratts et al.

(10) Patent No.: US 12,345,184 B2
(45) Date of Patent: Jul. 1, 2025

(54) DIESEL ENGINE AFTERTREATMENT SYSTEM

(71) Applicant: Caterpillar Inc., Peoria, IL (US)

(72) Inventors: Joshua L. Ratts, Pine Village, IL (US); Robert D. Clayton, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/229,469

(22) Filed: Aug. 2, 2023

(65) Prior Publication Data

US 2025/0043711 A1 Feb. 6, 2025

(51) Int. Cl.

| | |
|---|---|
| ***F01N 11/00*** | (2006.01) |
| ***F01N 3/021*** | (2006.01) |
| ***F01N 3/28*** | (2006.01) |
| ***F01N 13/00*** | (2010.01) |

(52) U.S. Cl.

CPC ..... *F01N 11/002* (2013.01); *F01N 3/021* (2013.01); *F01N 3/2892* (2013.01); *F01N 13/0097* (2014.06); *F01N 2550/02* (2013.01); *F01N 2550/04* (2013.01)

(58) Field of Classification Search

CPC .. F01N 13/02; F01N 13/0097; F01N 13/0093; F01N 13/017; F01N 13/011; F01N 13/04; F01N 13/1838; F01N 2250/02; F01N 3/035; F01N 3/021; F01N 3/2066; F01N 2590/08

See application file for complete search history.

(56) References Cited

U.S. PATENT DOCUMENTS

| | | | | |
|---|---|---|---|---|
| 8,715,578 | B2 | 5/2014 | Fukuda | |
| 8,950,176 | B2 | 2/2015 | Uzkan et al. | |
| 9,797,285 | B2 * | 10/2017 | Justin | B01D 46/0005 |
| 2013/0000277 | A1 * | 1/2013 | Uzkan | F02D 41/0087 60/297 |
| 2021/0189931 | A1 * | 6/2021 | Zhang | F02D 41/1461 |
| 2022/0290602 | A1 * | 9/2022 | Ratts | B01D 46/0086 |
| 2024/0044272 | A1 * | 2/2024 | Johnson | F01N 3/035 |

FOREIGN PATENT DOCUMENTS

| | | |
|---|---|---|
| CN | 107956544 | 4/2018 |
| KR | 101591350 | 2/2016 |
| KR | 102240510 | 4/2021 |
| KR | 102471932 B1 * | 11/2022 |

OTHER PUBLICATIONS

English Translation KR-102471932-B1 (Year: 2022).*

* cited by examiner

*Primary Examiner* — Anthony Ayala Delgado

(74) *Attorney, Agent, or Firm* — Schwegman Lundberg & Woessner, P.A.

(57) ABSTRACT

Apparatus, devices and methods including apparatus for aftertreatment for a diesel engine, optionally including: a housing having an inlet, an outlet and defining a cavity therein; a plurality of tubes mounted within the cavity and arranged to define a multi-flow split arrangement to pass an exhaust flow of the diesel engine through each of the plurality of tubes; and a plurality of treatment units configured to treat the exhaust flow within the housing, wherein each of the plurality of treatment units is coupled within a corresponding one of the plurality of tubes to receive a portion of the exhaust flow. A number of the plurality of treatment units utilized to treat the exhaust flow within the housing is less than a number of the plurality of tubes such that at least one of the plurality of tubes does not contain one of the plurality of treatment units.

22 Claims, 11 Drawing Sheets

DIESEL ENGINE AFTERTREATMENT SYSTEM

TECHNICAL FIELD

The present application relates generally to exhaust treatment systems. More particularly, the present application relates to aftertreatment apparatuses, systems and methods for treatment of exhaust from diesel engines and to techniques for varying the capture of diesel particles and controlling nitrogen gas and other emissions.

BACKGROUND

Waterborne vessels and, in particular, large waterborne vessels are often powered by diesel engines. In some cases, the power from these diesel engines can be used for propulsion, but the power may also be converted to electricity to provide electric power to other aspects of the vessel.

Emission control regulations continue to evolve and become more stringent as environmental concerns over combustion engine emissions continue to increase. In some areas of the world, emission controls may be lower for waterborne vessels as compared with European Union or other jurisdictions. These emission restrictions can relate to particle numbers and/or nitrogen gas emissions.

Korean Patent No. 101491350, U.S. Pat. No. 9,797,285 and United States Patent Application Publication No. 2022/0290602 are directed toward diesel aftertreatment systems and apparatuses. However, these patents and patent applications do not address varying the capture of diesel particles and/or controlling emissions in the manner of the present application.

SUMMARY

In one or more embodiments, an apparatus for aftertreatment for a diesel engine, optionally including: a housing having an inlet, an outlet and defining a cavity therein; a plurality of tubes mounted within the cavity and arranged to define a multi-flow split arrangement to pass an exhaust flow of the diesel engine through each of the plurality of tubes; and a plurality of treatment units configured to treat the exhaust flow within the housing, wherein each of the plurality of treatment units is coupled within a corresponding one of the plurality of tubes to receive a portion of the exhaust flow. A number of the plurality of treatment units utilized to treat the exhaust flow within the housing is less than a number of the plurality of tubes such that at least one of the plurality of tubes does not contain one of the plurality of treatment units.

In one or more embodiments, an aftertreatment system for a diesel engine, optionally including: a housing configured for placement in fluid communication with the diesel engine to receive an exhaust flow therefrom, the housing includes a plurality of tubes mounted within the housing and arranged to define a multi-flow split arrangement to pass the exhaust flow of the diesel engine through each of the plurality of tubes; and a plurality of treatment units selectively removable and insertable into the plurality of tubes. The plurality of treatment units are configured for treatment of the exhaust flow, and a number of treatment units utilized to treat the exhaust flow within the housing is selectively changeable relative to a number of the plurality of tubes.

In one or more embodiments, a method of aftertreatment of exhaust from a diesel engine, optionally including: receiving an exhaust flow from the diesel engine into an apparatus that defines a multi-flow split arrangement, passing the exhaust flow in parallel through the multi-flow split arrangement, treating the exhaust flow of less than all of the multi-flow split arrangement, recombining the exhaust flow within the apparatus, and passing the exhaust flow from the apparatus.

DETAILED DESCRIPTION

Figure 1:
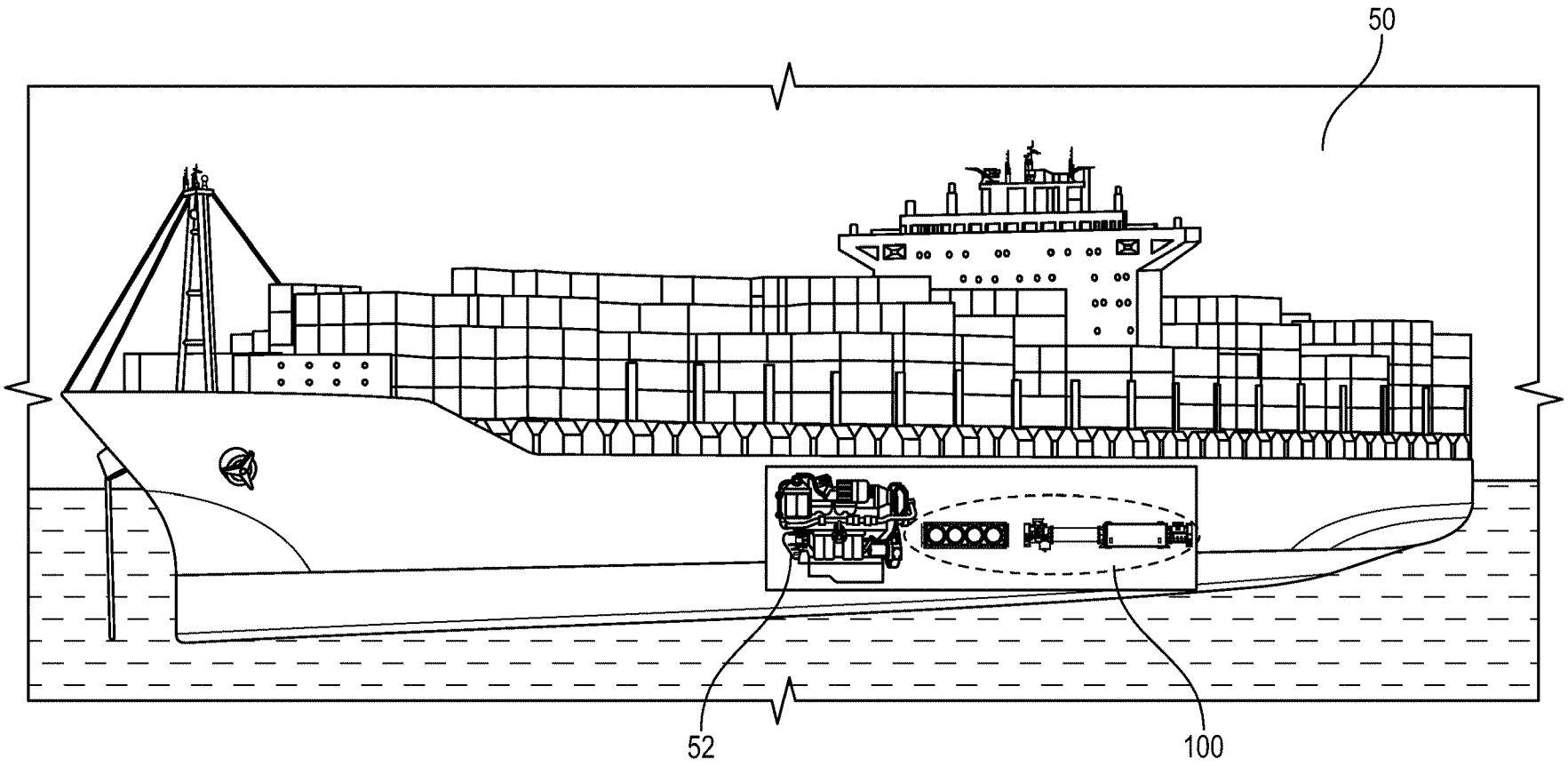
FIG. 1 is a perspective view of a waterborne vessel having a diesel engine and an aftertreatment system for exhaust from the diesel engine, according to one or more examples.

FIG. 1 is a side perspective view of a waterborne vessel 50. The vessel 50 may be a work vessel, cargo vessel, cruise vessel or other type of waterborne vessel. In one or more examples, the waterborne vessel 50 may be powered by one or more diesel engines 52, which may be adapted to provide propulsion and/or propulsion in combination with electrical generation. As shown, the diesel engine 52 may include an aftertreatment system 100 configured for treating the exhaust of the engine 52 prior to releasing the exhaust into the atmosphere. While the present application has been drafted in the context of waterborne vessel power, the aftertreatment system 100 described herein may be applicable for providing aftertreatment to any diesel-powered work machine, stationary power generation engine or other diesel-powered equipment, automobile, or machine.

Figure 2:
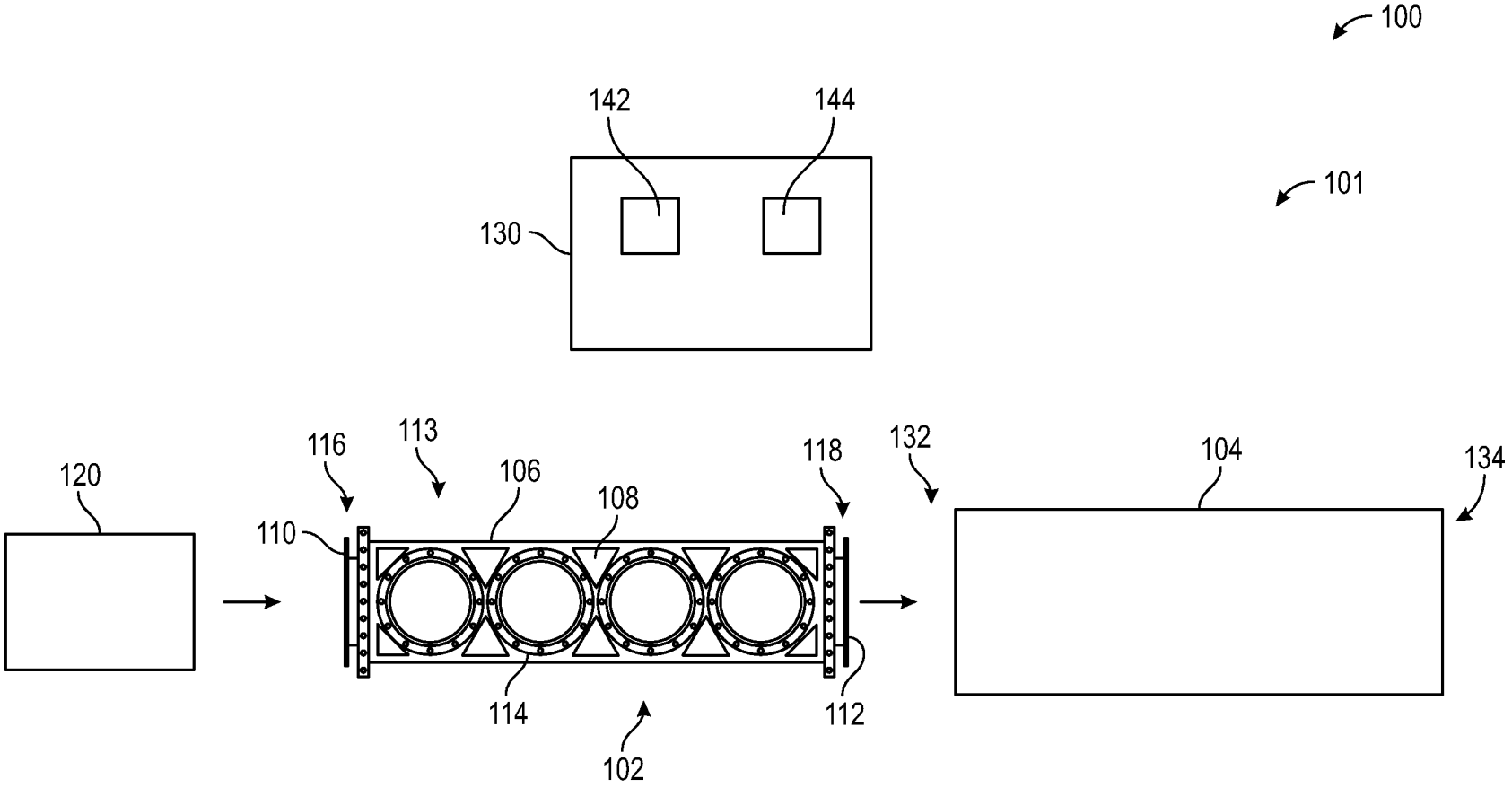
FIG. 2 is a schematic view of one example of an aftertreatment system, according to one or more examples.

Referring now to FIG. 2, a side view of the aftertreatment system 100 for the diesel engine is shown. The aftertreatment system 100 may be configured to reduce emissions from the diesel engine. In particular, the aftertreatment system 100 may be configured to control particle emissions, nitrogen gas emissions and/or other emissions from the diesel engine. As shown, the aftertreatment system 100 may include an apparatus 101 such as a diesel particulate filter (DPF) 102, a selective catalytic reduction (SCR) system 104 and/or a diesel oxidation catalyst (DOC) 120. Moreover, the SCR 104 may be designed for operation apart from or in conjunction with the DPF 102. The systems and methods contained herein are applicable to varying particulate and/or emission of the DPF 102, the SCR 104, the DOC 120 and/or other components that utilize a multi-flow split arrangement. Put another way, the principles and techniques discussed herein can be applied to either the DPF 102, the SCR 104, the DOC 120, etc.

The DPF 102 can be configured to filter out diesel particulate in an exhaust flow from the diesel engine. For example, the DPF 102 may be configured to filter out soot and ash from the exhaust stream. Moreover, the DPF 102 may be configured for ongoing (e.g., passive) regeneration. In one or more examples, the DPF 102 can include a housing 106 forming a cavity 108 and having an inlet 110 and outlet 112. The DPF 102 can be constructed to define a multi-flow split arrangement 113 for the exhaust flow. The DPF 102 can also include a filtration system 114 within the housing 106 (e.g., arranged in the cavity 108) along one or more of the multi-flow split arrangement 113. The multi-flow split arrangement 113 defines a number of fluid pathways through the DPF 102 from the inlet 110 to the outlet 112. The filtration system 114 may include one or more treatment units (discussed subsequently) such as filter media arranged within one or more of the fluid pathways. The exhaust flow from the diesel engine passes through the one or more of treatment units before exiting the DPF 102. Various constructs for the one or more treatment units and the filtration system 114 are known. An exemplary configuration is discussed herein with the understanding the principles and techniques can be applied to other configurations for the one or more treatment units and the filtration system 114. The one or more of treatment units may have a porosity selected to allow exhaust gas through the filter media while reducing or preventing passage of ash and soot. For purposes discussed herein and for other purposes, the DPF 102 may also include first and second sensors 116/118 such as at the inlet/outlet of the DPF 102, respectively. The sensors 116/118 may be absolute pressure sensors, particulate sensors, emission sensors, combinations thereof, or the like. As an example, the sensors 116/118 can be configured for sensing respective pressures at the inlet/outlet 110/112 such that a differential pressure or pressure drop across the DPF 102 may be calculated or determined.

As mentioned, the DPF 102 may also be configured for ongoing (e.g., passive) regeneration. For example, the DOC 120 may be provided upstream of the DPF 102. The DOC 120 can function to produce nitrogen dioxide ($NO_2$). For example, the DOC 120 may include an oxidation catalyst that functions to absorb oxygen from the exhaust gas providing an opportunity for other elements in the exhaust gas to react with the bonded oxygen. In particular, nitric oxide (NO) may react with the oxygen to form nitrogen dioxide ($NO_2$). When the nitrogen dioxide passes through the one or more treatment units in the DPF 102, the nitrogen dioxide may react with the carbon in the soot to form carbon dioxide ($CO_2$), which may then pass through the one or more treatment units such as filter media. Alternatively or additionally, the DPF 102 may include a catalyst as the one or more treatment units or the one or more treatment units can include a combination of a catalyst and the filter media. The catalyst can function to generate $NO_2$. The $NO_2$ generated in the filter media may back diffuse through the filter media and react with the soot to form $CO_2$, which may pass through the filter media and out of the DPF 102. In either case, some of the $NO_2$ generated either in the DOC 120 or within the filter media of the DPF 102 may not be fully absorbed or utilized in the regeneration process and, as such, the nitrogen oxide gases ($NO_x$) leaving the DPF 102 may be a combination of NO and $NO_2$. It is to be appreciated that while the DOC 120 has been shown outside of the DPF 102, it may also be incorporated therein.

The SCR system 104 can be arranged downstream of the DPF 102. The SCR 104 may be configured to reduce the amount of nitrogen oxide gas ($NO_x$) in the exhaust before it is released into the atmosphere. In particular, the SCR 104 may function to react ammonia ($NH_3$) with $NO_x$ in the exhaust gas to produce nitrogen and water and, as such, reduce the emission of $NO_x$. The SCR 104 may include a housing defining an internal cavity and having an inlet and an outlet. The SCR 104 may have a diesel exhaust fluid (DEF) reservoir in fluid communication with the cavity via a controllable valve or nozzle. In one or more examples, the DEF may be in fluid communication with the exhaust stream upstream of the SCR 104 and not directly in the cavity. The SCR 104 may also have one or more of treatment units such as a series of catalysts arranged within the cavity. For example, the SCR 104 may include a hydrolysis catalyst adapted to convert liquid urea to ammonia, for example. The SCR may also include an SCR catalyst to convert the ammonia and $NO_x$ to nitrogen and water. The SCR catalysts may include various porous ceramic materials with active catalytic components arranged on the ceramic material. For example, the SCR catalyst may include oxides of base metals such as vanadium, molybdenum, and tungsten, zeolites, or various precious metals may be used. Still other active catalytic components may be used. In one or more examples, the SCR 104 may also include an oxidation catalyst or an ammonia slip catalyst to address any remaining ammonia in the exhaust gas. The SCR 104 may also include an inlet $NO_x$ sensor 132 and an outlet $NO_x$ sensor 134.

The aftertreatment system 100 may also include a controller 130 that determines, alerts, recommends and/or controls as further discussed herein. For example, the aftertreatment system 100 can include the plurality of sensors (e.g., the sensors 116/118, 132, 134) configured to measure at least a NOx concentration and a diesel particulate concentration in the exhaust flow of the aftertreatment system 100. Additionally, the plurality of sensors (e.g., the sensors 116/118, 132, 134) can be configured to measure other parameters such as pressure, pressure drop, temperature, temperature drop, particulate concentration, soot loading, etc. The controller 130 can be configured to determine/calculate various parameters based upon the data/input from the plurality of sensors. For example, the controller 130 can be configured to determine a NO2 to NOx ratio and a filtration efficiency based upon data from the plurality of sensors. The controller 130 can be configured to compare the NO2 to NOx ratio and the filtration efficiency to governing regulatory standards. The controller 130 can be configured to recommend via a display at least a desired number of the plurality of treatment units that should be utilized with the DPF 102, SCR 104 and/or DOC 120. The controller 130 can be configured to perform other functions as further discussed herein including recommending an orifice size configured to restrict the exhaust flow be installed within one or more of the DPF 102, SCR 104 and/or DOC 120. The controller 130 can be configured to control a valve to adjust to restrict the exhaust flow through the DPF 102, SCR 104 and/or DOC 120. The controller 130 can be configured to determine based upon sensed data at least a pressure drop in the exhaust flow of the aftertreatment system or a soot loading of the plurality of treatment units and displays at least the pressure drop or the soot loading along with the display of the at least the desired number of the plurality of treatment units that should be utilized within the DPF 102, SCR 104 and/or DOC 120.

Software 142 and memory 144 may be present in the controller 130, which may be used for the various determinations, recommendations, outputs, alerts, controls, etc. discussed herein. The controller 130 can include the memory 144, display, input and other features and components. The controller 130 can include, for example, software 142, hardware, and combinations of hardware and software configured to execute several functions related to control of emissions and/or particulate as described herein. For example, the memory 144 can include stored data that reflects relationships between an orifice size the exhaust flow passes through and a combination of the NO2 to NOx ratio, the filtration efficiency, the soot loading and the pressure drop for various configurations of the DPF 102, SCR 104 and/or DOC 120. The controller 130 can include an analog, digital, or combination analog and digital controller including a number of components. As examples, the controller 130 can include integrated circuit boards or ICB (s), printed circuit boards PCB(s), processor(s), data storage devices, switches, relays, or any other components. Examples of processors can include any one or more of a microprocessor, a controller, a digital signal processor (DSP), an application specific integrated circuit (ASIC), a field-programmable gate array (FPGA), or equivalent discrete or integrated logic circuitry.

The controller 130 can include or can be coupled to the memory 144 such as storage media to store and/or retrieve data or other information such as, for example, the relationships between the orifice size the exhaust flow passes through and a combination of the NO2 to NOx ratio, the filtration efficiency, the soot loading and the pressure drop. The controller 130 via memory 144 may also store other information. Storage devices, in some examples, are described as a computer-readable storage medium. The memory 144 can be used to store program instructions for execution by the controller 130, for example. The memory 144, for example, is used by software 142, applications, algorithms, as examples, running on and/or executed by the controller 130. The memory 144 can include short-term and/or long-term memory and can be volatile and/or non-volatile. Examples of non-volatile storage elements include magnetic hard discs, optical discs, floppy discs, flash memories, or forms of electrically programmable memories (EPROM) or electrically erasable and programmable (EEPROM) memories. Examples of volatile memories include random access memories (RAM), dynamic random access memories (DRAM), static random access memories (SRAM), and other forms of volatile memories known in the art.

Figure 3:
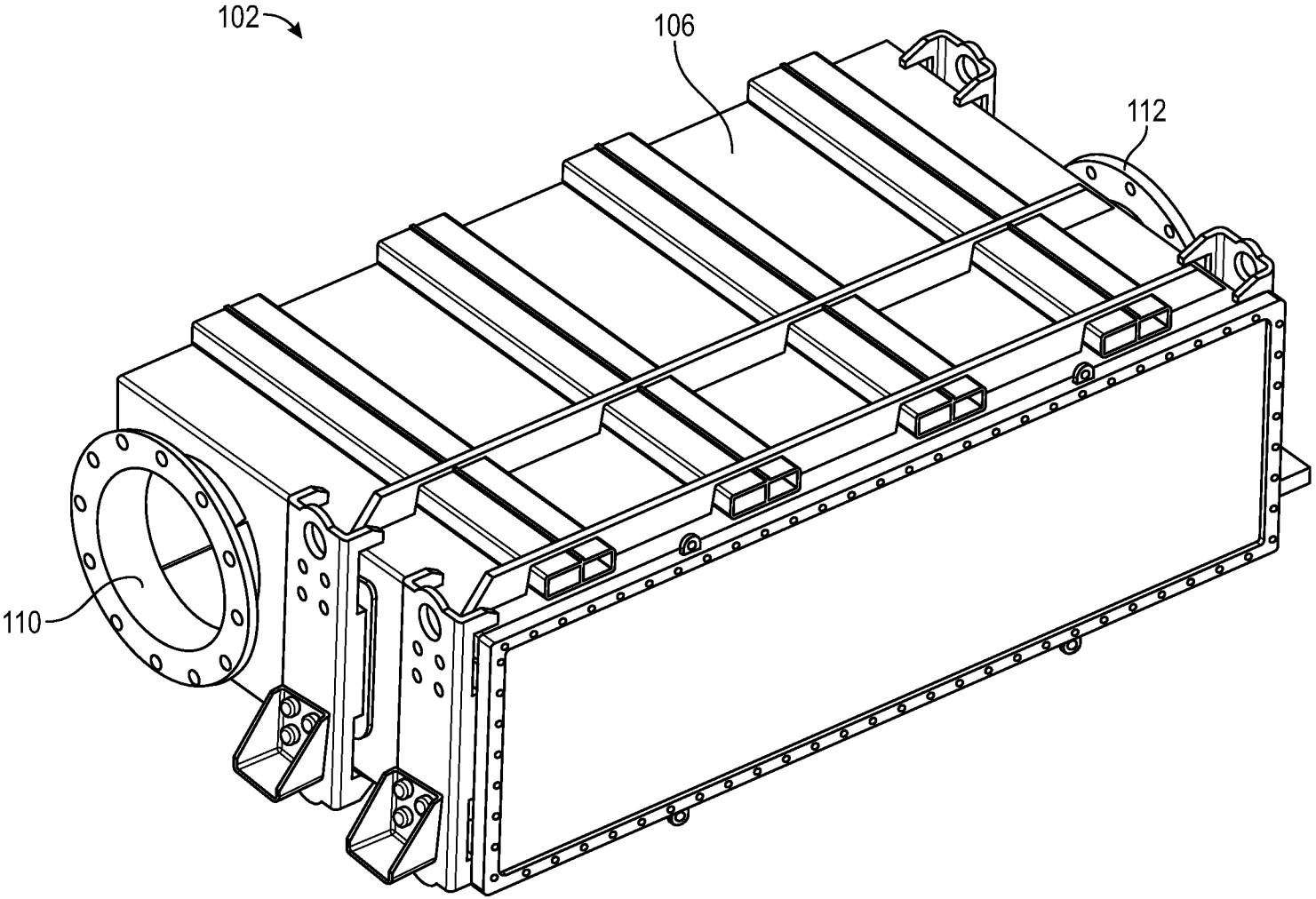
FIG. 3 is a perspective view of an apparatus used in treatment of the exhaust from the diesel engine, according to one or more examples.

FIG. 3 shows an example of the DPF 102 according to one example. However, the principles and techniques discussed herein can be applied to the SCR 104, the DOC 120 (FIG. 2) or other apparatuses in addition to or in alternative to the DPF 102. The DPF 102 can include the housing 106, the inlet 110, the outlet 112 as discussed previously. The inlet 110 can be configured to receive exhaust flow from the diesel engine. The outlet 112 can release treated exhaust flow from the DPF 102 to the remainder of the aftertreatment system 100 (FIG. 2). The housing 106 can have a box like configuration with one or more walls thereof removable to access the interior including the plurality of treatment units therein.

Figure 4:
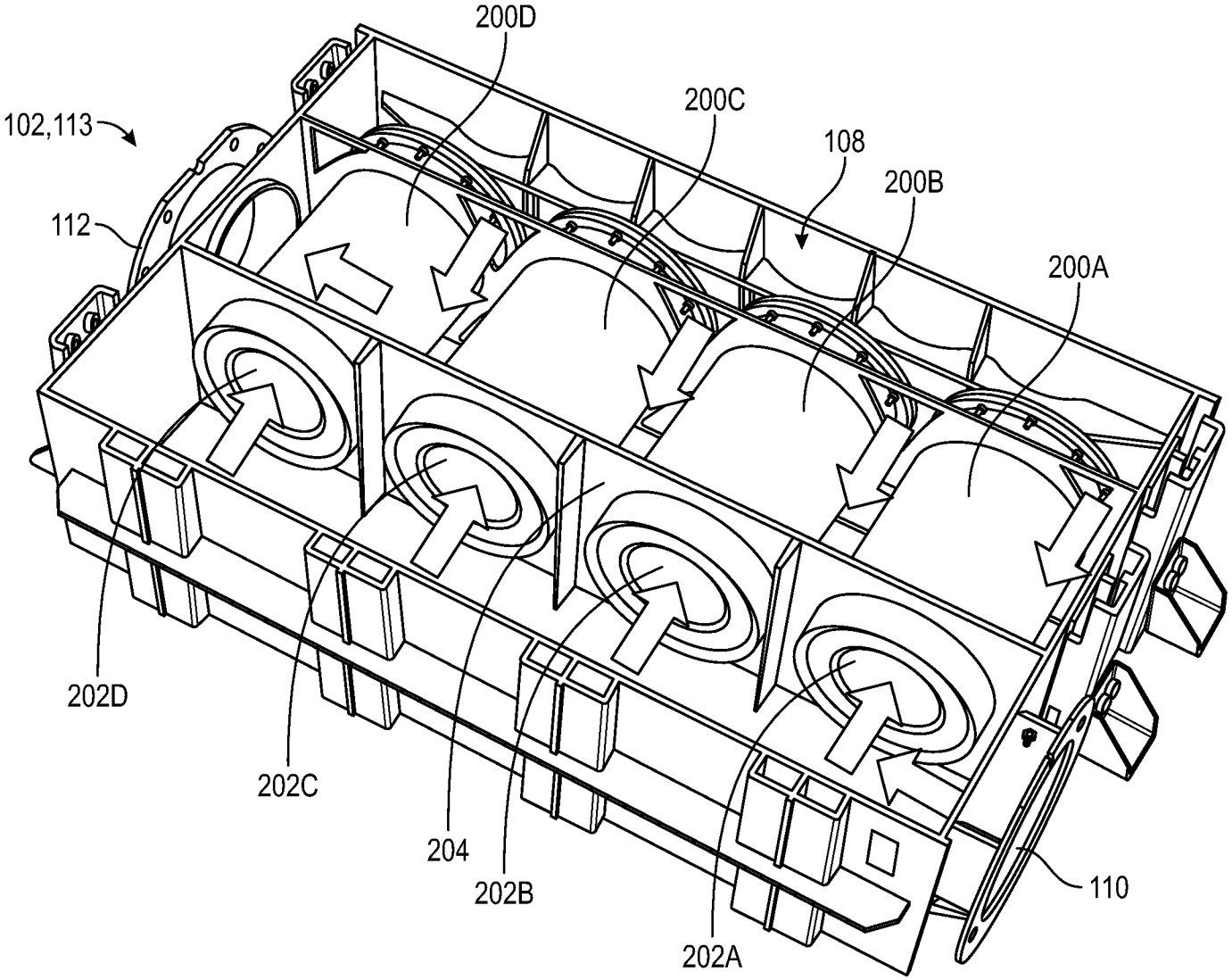
FIG. 4 is a perspective view of the apparatus of FIG. 3 with a portion of the housing removed to show an interior cavity with a multi-flow split arrangement, according to one or more examples.

FIG. 4 shows the DPF 102 with portions such as a wall of the housing 106 removed to show the cavity 108, a plurality of tubes 200A, 200B, 200C and 200D, a plurality of treatment units 202A, 202B, 202C and 202D and an interior wall 204. The inlet 110 and the outlet 112 are also shown in FIG. 4.

The housing 106, plurality of tubes 200A, 200B, 200C and 200D and the interior wall 204 are configured to define the multi-flow split arrangement 113. The plurality of treatment units 202A, 202B, 202C and 202D can be positioned in the respective ones of the plurality of tubes 200A, 200B, 200C and 200D. As shown by arrows in FIG. 4, the exhaust flows into an initial cavity from the inlet 110, through the plurality of tubes 200A, 200B, 200C and 200D and the plurality of treatment units 202A, 202B, 202C and 202D in parallel as indicated with arrows. The treated exhaust then flows back along an outside of the plurality of tubes 200A, 200B, 200C and 200D to the outlet 112 as indicated with further arrows.

Figure 5:
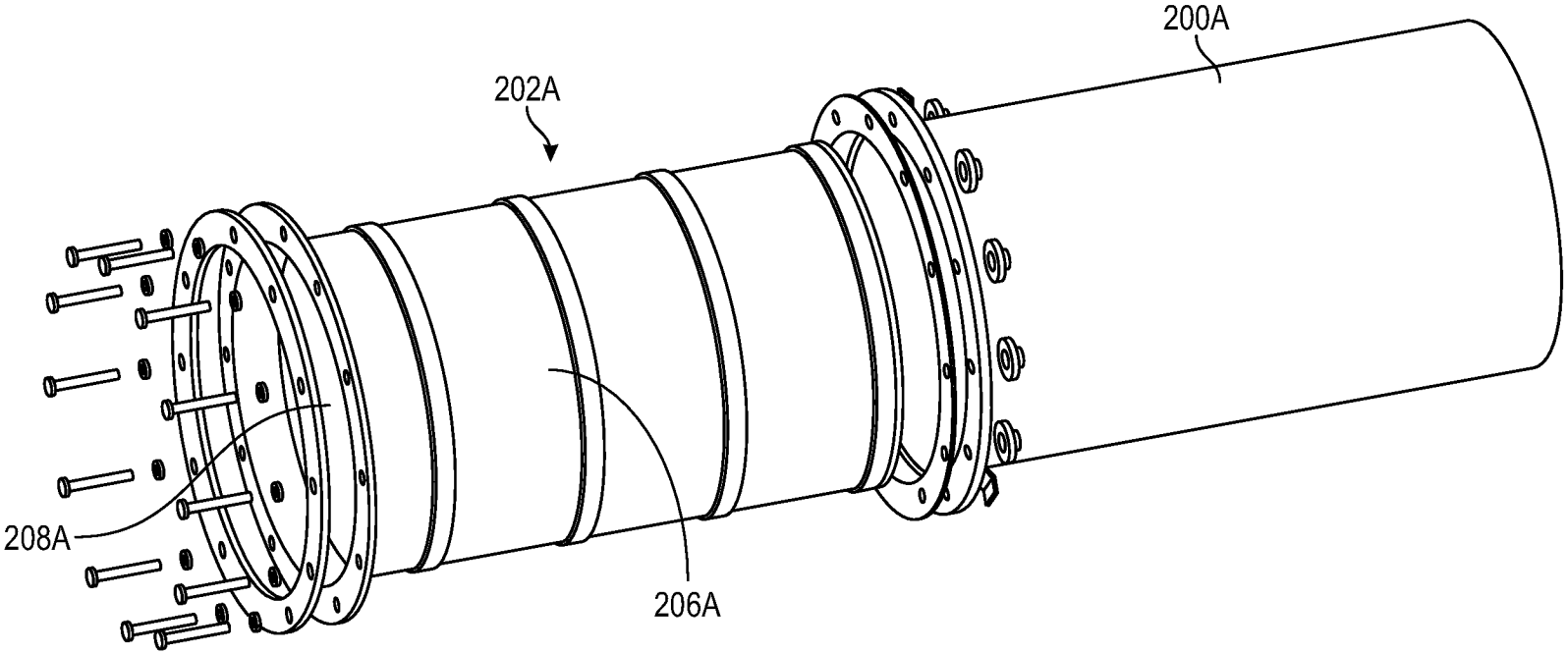
FIG. 5 is an exploded view of a tube and a treatment unit of the apparatus of FIGS. 3 and 4, according to one or more examples.

FIG. 5 shows one of the plurality of tubes 200A and one of the plurality of treatment units 202A in an exploded view. The treatment unit 202A can be configured to be insertable in and removable from an interior of the tube 200A. The treatment unit 202A can be coupled to the tube 200A by various components such as flanges, bolts, gaskets, etc. The tube 200A can be configured to support and retain the treatment unit 202A.

Figure 6:
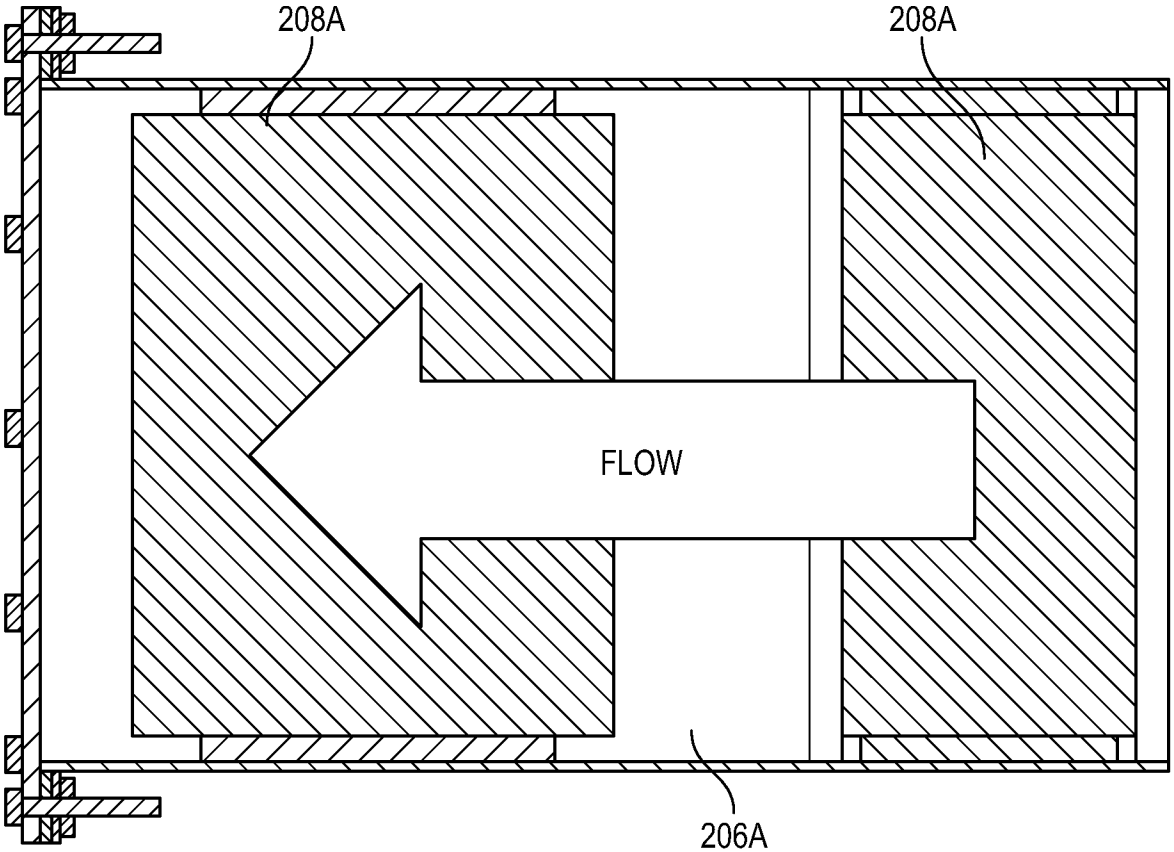
FIG. 6 is a cross-sectional view of the treatment unit of FIG. 5, according to one or more examples.

As shown in FIG. 5, the treatment unit 202A can include a sleeve 206A and a treatment apparatus 208A. The sleeve 206A can be configured to receive the treatment apparatus 208A therein. The sleeve 206A can be insertable and removable from the corresponding one of the plurality of tubes (here tube 200A). The sleeve 206A can have a hollow tube construction. The treatment apparatus 208A can be diesel particle filter (filter media) or a catalyst unit. As shown in FIG. 6, the sleeve 206A can be configured to retain two or more treatment apparatuses 208A such as a diesel particle filter and a catalyst unit in a series flow path for the exhaust.

Figure 7:
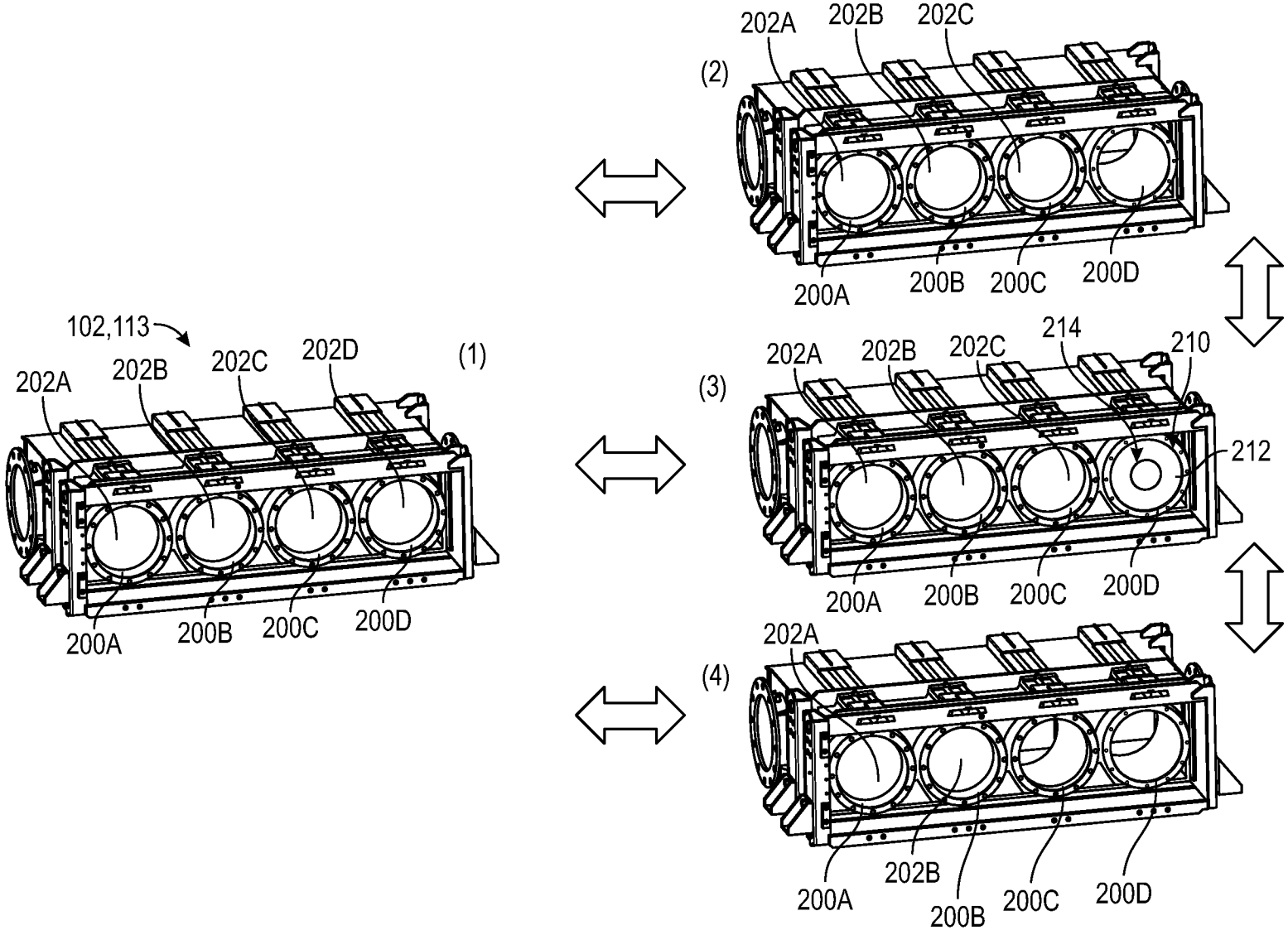
FIG. 7 is a schematic view of the apparatus of FIGS. 3-6 with various example configurations of the apparatus and treatment units, according to one or more examples.

FIG. 7 shows various exemplary configurations for the DPF 102. In configuration (1), each of the plurality of tubes 200A, 200B, 200C and 200D have a corresponding one of the plurality of treatment units 202A, 202B, 202C and 202D installed therein. In configuration (2), a number of the plurality of treatment units 202A, 202B and 202C utilized to treat the exhaust flow within the DPF 102 has been varied from configuration (1) and is less than a number of the plurality of tubes 200A, 200B, 200C and 200D such that at least one of the plurality of tubes 200A, 200B, 200C and 200D is empty and does not contain one of the plurality of treatment units (treatment unit 202D is absent having been removed from the DPF 102). Thus, exhaust flow through one of the multi-flow split arrangement 113 of configuration (2), the tube 200D, is untreated.

In configuration (3), the DPF 102 has been varied from configuration (1) such that the at least one of the plurality of tubes 200A, 200B, 200C and 200D (tube 200D) does not contain one of the plurality of treatment units 202A, 202B and 202C as treatment unit 202D is absent. In configuration (3), the tube 200D includes a restriction device 210 configured to restrict the exhaust flow through the tube 200D. As shown in FIG. 7, the restriction device 210 can comprise an apparatus 212 such as a ring, sleeve, insert or the like, that defines an orifice 214. Thus, some of the exhaust flow can pass through the tube 200D but the flow is restricted by the restriction device 210.

FIG. 7 shows yet another configuration (4) for the DPF 102, where two of the plurality of tubes 200C and 200D do not contain one of the plurality of treatment units and only treatment units 202A and 202B are utilized. Thus, treatment units 202C and 202D are absent and have been removed from the DPF 102. Exhaust flow through two of the multi-flow split arrangement 113, the tubes 200C and 200D, is untreated.

Figure 8:
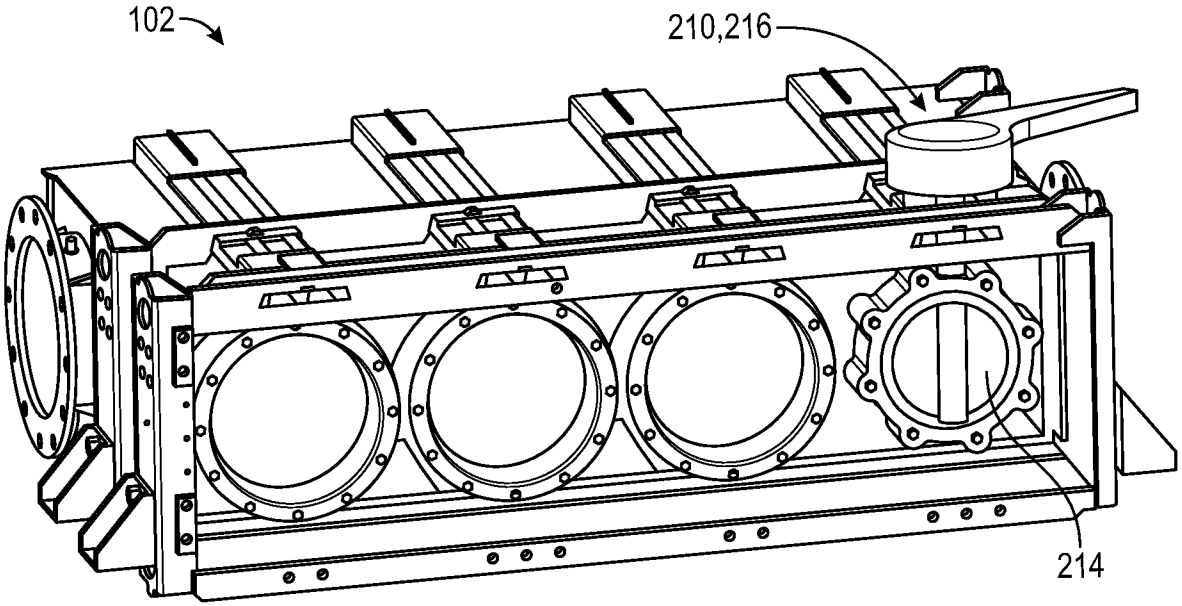
FIG. 8 is a schematic view of yet another apparatus used in treatment of the exhaust from the diesel engine including a variable valve to provide restriction to a flow path for exhaust, according to one or more examples.

FIG. 8 shows yet another configuration (5) for the DPF 102, where the DPF 102 includes the restriction device 210, which is a valve 216 having a variable/adjustable orifice 214. The valve 216 can be manually or electronically controlled by the controller 130 (FIG. 2) discussed previously to adjust the size of the orifice 214.

INDUSTRIAL APPLICABILITY

Figure 9:
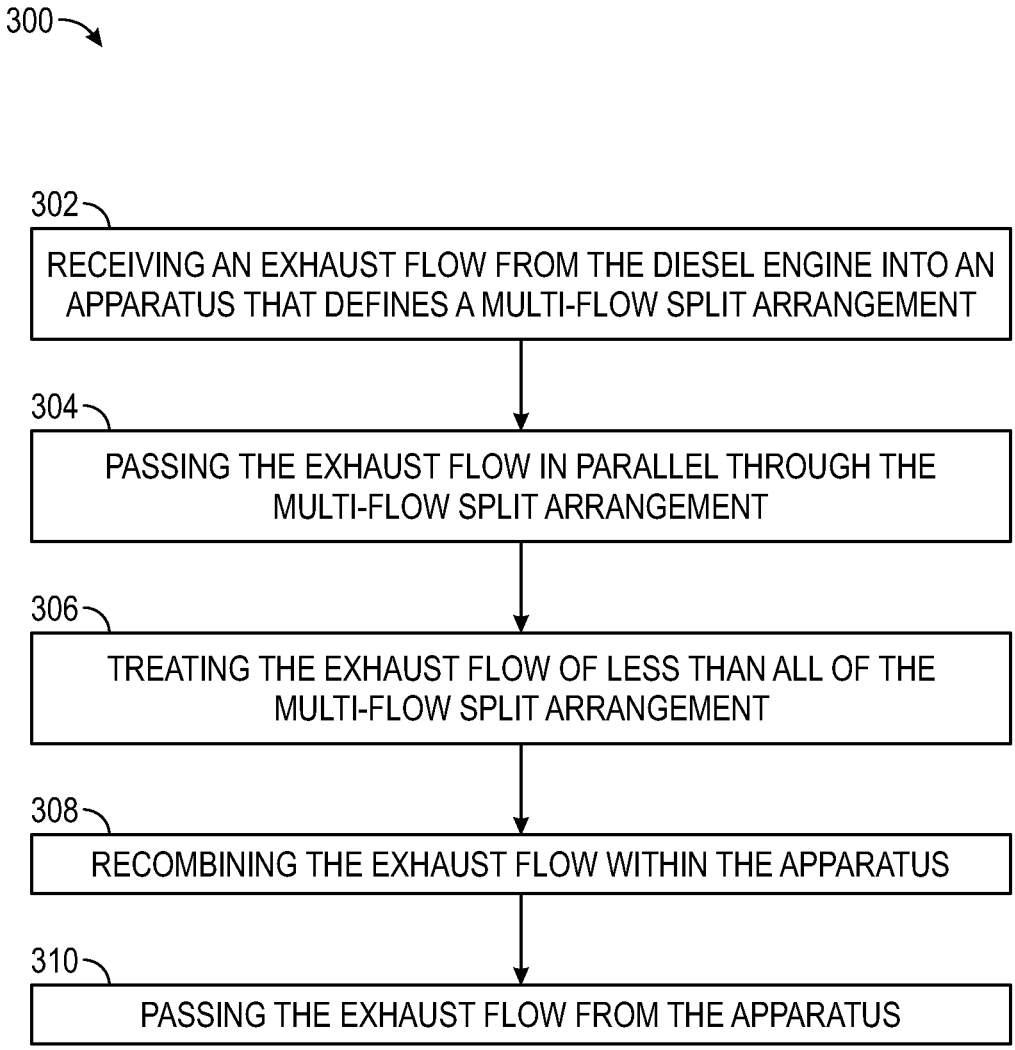
FIG. 9 is a diagram depicting a method of operation of an aftertreatment system, according to one or more embodiments.
Figure 10A:
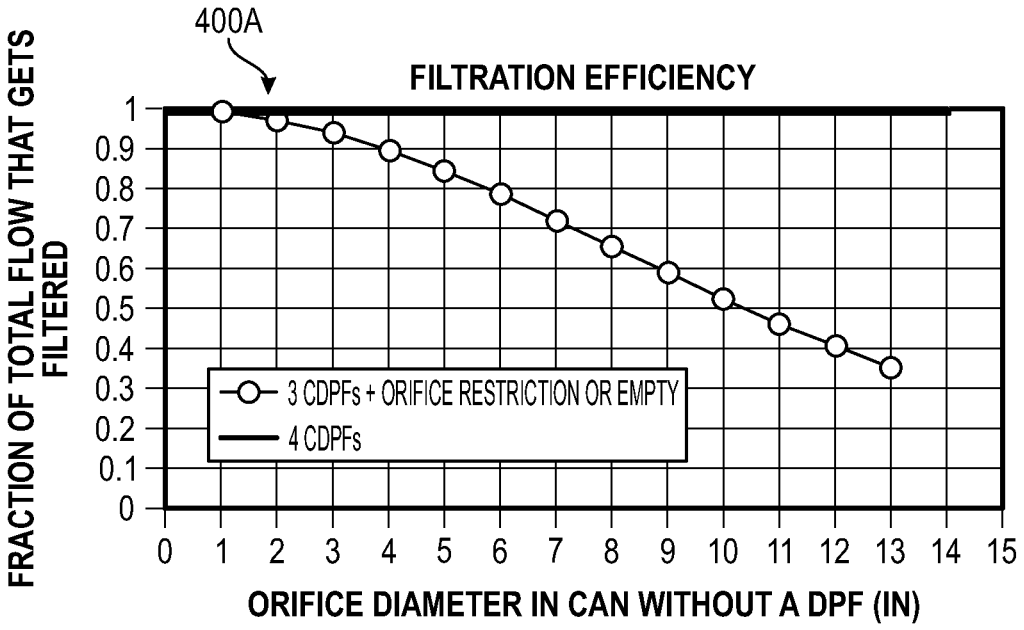
FIGS. 10A-10D are graphs of reflecting relationships between an orifice size the exhaust flow passes through and a combination of a NO2 to NOx ratio, a filtration efficiency, a soot loading and a pressure drop, according to one or more examples.
Figure 10B:
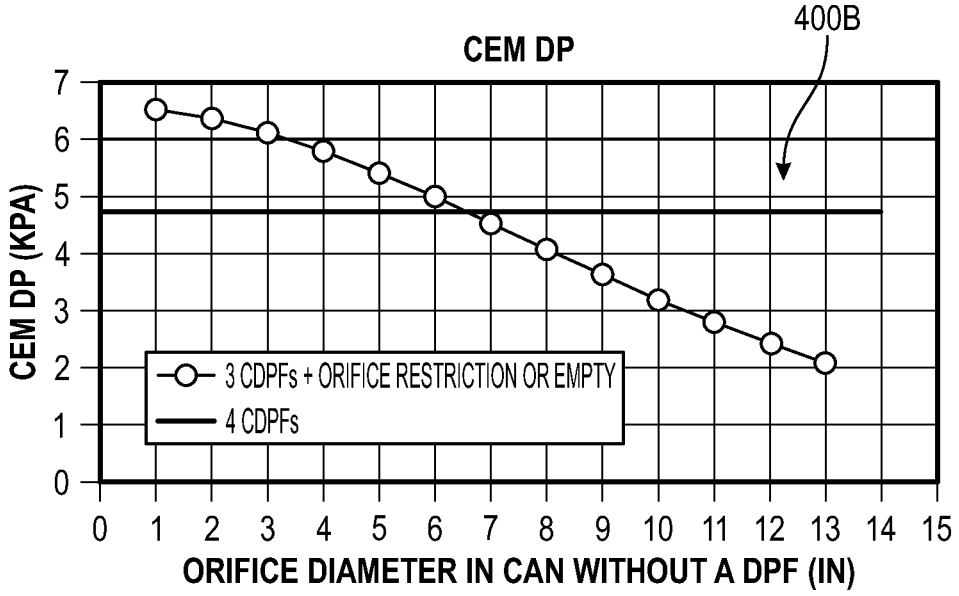
Figure 10C:
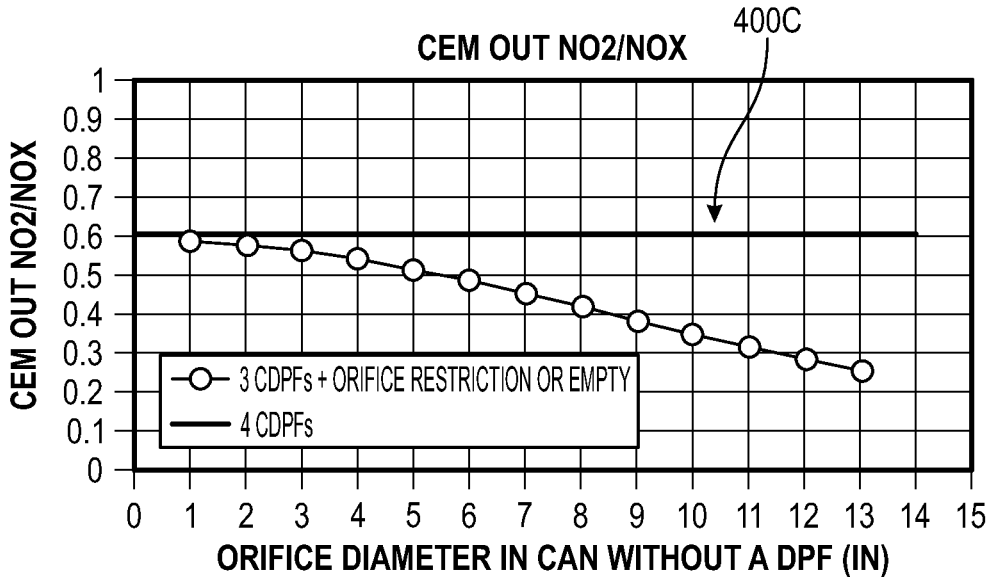
Figure 10D:
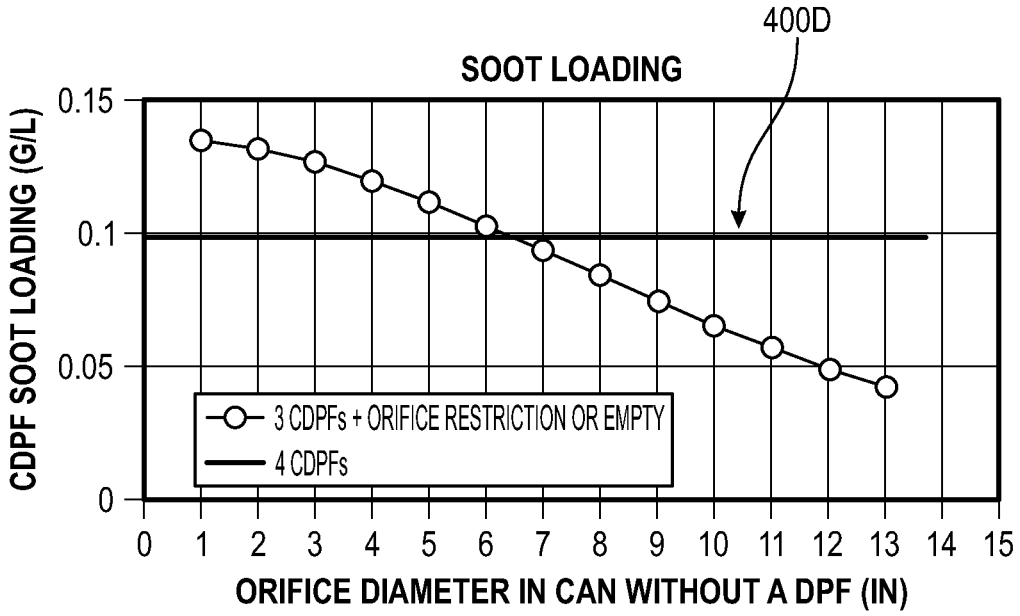

In operation and use, a method 300 of operation of an aftertreatment system according to one example is shown in FIG. 9. The method 300 can include receiving 302 an exhaust flow from the diesel engine into an apparatus (e.g., DPF 102, SCR 104 and/or DOC 120) that defines a multi-flow split arrangement. The method 300 can include passing 304 the exhaust flow in parallel through the multi-flow split arrangement and treating 306 the exhaust flow of less than all of the multi-flow split arrangement. The method 300 can further include recombining 308 the exhaust flow within the apparatus and passing 310 the exhaust flow from the apparatus.

Optionally the method 300 can include treating the exhaust flow of less than all of the multi-flow split arrangement includes removing or varying one or more of a plurality of treatment units from the apparatus based upon determining a NO2 to NOx ratio and a filtration efficiency and comparing the NO2 to NOx ratio and the filtration efficiency to governing regulatory standards. The method 300 can optionally include treating the exhaust flow of less than all of the multi-flow split arrangement includes leaving at least one of a plurality of tubes that define the multi-flow split arrangement empty or placing a restriction device within the at least one of the plurality of tubes to restrict the exhaust flow.

The method 300 can optionally include sensing NOx concentration and a diesel particulate concentration in the exhaust flow, determining a NO2 to NOx ratio and a filtration efficiency, and comparing the NO2 to NOx ratio and the filtration efficiency to governing regulatory standards. The method 300 can optionally include outputting a recommendation of at least a number of treatment units to install within the apparatus to treat the exhaust flow and/or outputting a recommendation to install a restriction device along one or more of the multi-flow split arrangement and a recommendation of an orifice size for the restriction device. The method 300 can optionally include determining based upon sensed data at least a pressure drop in the exhaust flow or a soot loading of the number of the treatment units and outputting at least the pressure drop or the soot loading along with the outputting of the recommendation of at least the number of treatment units to install or the recommendation to install the restriction device. The method 300 can optionally include adjusting a valve within at least one of the multi-flow split arrangement to restrict the exhaust flow therethrough.

FIGS. 10A-10D graphically show data that can be stored and utilized by the aftertreatment system 100, controller 130 and the method 300. The data was simulated and tested on an diesel engine with an exhaust flow rate of 7373 kg/hr and an exhaust flow temperature of 377° C. The data can be tabulated or otherwise organized such as with graphs 400A, 400B, 400C and 400D. However, other forms of data such as sensor data, memory data, tables, raw data, algorithm and/or other information can be utilized. The graph 400A shows filtration efficiency of the DPF as calculated and plotted with different orifice sizes used for the tube 200D (FIG. 7) and the other tubes 200A, 200B, 200C including the filtration units 202A, 202B and 202C. The orifice size (1 inch to 12 inches) would be achieved with installation of different restriction devices defining different orifices, for example or by the valve of FIG. 8. A 13 inch diameter point on the graph 400A for the tube 200D corresponds to no restriction device being installed (i.e., the tube 200D has the configuration (2) of FIG. 7). The graph 400A additionally plots filtration efficiency with all the tubes 200A, 200B, 200C and 200D having corresponding ones of the filtration units 202A, 202B, 202C and 202D installed. Thus, the graph 400A shows the filtration efficiency of the DPF 102 of FIG. 7 having the configuration (1) compared with the other configurations (2) and (3) of FIG. 7.

The graph 400B shows pressure drop across the DPF as calculated and plotted with different orifice sizes used for the tube 200D (FIG. 7) and the other tubes 200A, 200B, 200C including the filtration units 202A, 202B and 202C. As discussed above, the orifice size would be achieved with installation of different restriction devices defining different orifices, for example, or by the valve of FIG. 8. A 13 inch diameter point on the graph 400B for the tube 200D corresponds to no restriction device being installed (i.e., the tube 200D has the configuration (2) of FIG. 7). The graph 400B additionally plots pressure drop across the DPF with all the tubes 200A, 200B, 200C and 200D having corresponding ones of the filtration units 202A, 202B, 202C and 202D for the DPF having the configuration (1) of FIG. 7.

The graph 400C plots the NO2 to NOx ratio as calculated and plotted with different orifice sizes used for the tube 200D (FIG. 7) and the other tubes 200A, 200B, 200C including the filtration units 202A, 202B and 202C. A 13 inch diameter point on the graph 400C for the tube 200D corresponds to no restriction device being installed (i.e., the tube 200D has the configuration (2) of FIG. 7). The graph 400C additionally plots the NO2 to NOx ratio with all the tubes 200A, 200B, 200C and 200D having corresponding ones of the filtration units 202A, 202B, 202C and 202D for the DPF having the configuration (1) of FIG. 7.

The graph 400D plots the soot loading as calculated and plotted with different orifice sizes used for the tube 200D (FIG. 7) and the other tubes 200A, 200B, 200C including the filtration units 202A, 202B and 202C. A 13 inch diameter point on the graph 400D for the tube 200D corresponds to no restriction device being installed (i.e., the tube 200D has the configuration (2) of FIG. 7). The graph 400D additionally plots the soot loading with all the tubes 200A, 200B, 200C and 200D having corresponding ones of the filtration units 202A, 202B, 202C and 202D for the DPF having the configuration (1) of FIG. 7.

The data such as filtration efficiency of the DPF, pressure drop across the DPF or system, NO2 to NOx ratio of the system and/or the soot loading of the DPF can be varied by adding or removing the number of filtration units and/or a size or number of restriction devices utilized with the DPF or other apparatuses of the system. These various configurations for the DPF or other apparatuses allows the system to be varied to achieve a desired filtration efficiency of the DPF and NO2 to NOx ratio for the system to meet governing regulatory standards while accounting for changes in other system parameters such as pressure drop across the DPF or system, soot loading of the DPF and/or other system criteria.

The above detailed description is intended to be illustrative, and not restrictive. The scope of the disclosure should, therefore, be determined with references to the appended claims, along with the full scope of equivalents to which such claims are entitled.

What is claimed is:

1. An apparatus for aftertreatment for an engine, comprising:

a housing having an inlet, an outlet and defining a cavity therein;

a plurality of tubes mounted within the cavity and arranged to define a multi-flow split arrangement to pass an exhaust flow of the engine through the plurality of tubes; and a plurality of treatment units configured to treat the exhaust flow within the housing, wherein each of the plurality of treatment units is coupled within a corresponding one of the plurality of tubes to receive a portion of the exhaust flow, and wherein a number of the plurality of treatment units utilized to treat the exhaust flow within the housing is less than a number of the plurality of tubes such that at least one of the plurality of tubes does not contain one of the plurality of treatment units;

wherein the at least one of the plurality of tubes that does not contain one of the plurality of treatment units includes a restriction device that defines an orifice that is configured to restrict another portion of the exhaust flow through the at least one of the plurality of tubes and wherein the orifice remains open during conditions in which no exhaust flow is passing through the plurality of tubes.

2. The apparatus of claim 1, wherein each of the plurality of treatment units includes a sleeve and a treatment apparatus, wherein the sleeve is configured to receive the treatment apparatus therein, and wherein the sleeve is insertable and removable from the corresponding one of the plurality of tubes.

3. The apparatus of claim 2, wherein each of the treatment apparatuses is one of a diesel particle filter or a catalyst unit.

4. The apparatus of claim 1, wherein the housing includes an internal wall that is coupled to the plurality of tubes, wherein the internal wall separates the inlet from the outlet with the plurality of tubes arranged in parallel.

5. The apparatus of claim 1, wherein the orifice is fixed.

6. The apparatus of claim 1, wherein the portion of the exhaust flow through the orifice of the restriction device is along a center of the restriction device.

7. The apparatus of claim 1, wherein exhaust flow through the inlet and the outlet are in a first direction and the portions of the exhaust flow through each of the treatment units and the another portion of the exhaust flow through the orifice are in a second direction, transverse to the first direction.

8. An aftertreatment system for a diesel engine, comprising:

a housing configured for placement in fluid communication with the diesel engine to receive an exhaust flow therefrom, wherein the housing includes a plurality of tubes mounted within the housing and arranged to define a multi-flow split arrangement to pass the exhaust flow of the diesel engine through the plurality of tubes;

a plurality of treatment units selectively removable and insertable into the plurality of tubes, wherein each of the plurality of treatment units is configured for treatment of a portion of the exhaust flow, wherein a number of treatment units utilized to treat the exhaust flow within the housing is selectively changeable relative to a number of the plurality of tubes;

a plurality of sensors configured to measure: a $NO_x$ concentration and a diesel particulate concentration in the exhaust flow of the aftertreatment system;

a controller configured to:

determine a $NO_2$ to $NO_x$ ratio and a filtration efficiency based upon data from the plurality of sensors;

compare the NO2 to NOx ratio and the filtration efficiency to governing regulatory standards; and recommend via a display at least a desired number of the plurality of treatment units that should be utilized within the plurality of tubes of the housing.

9. The aftertreatment system of claim 8, wherein the controller via the display identifies an apparatus defining an orifice configured to restrict the exhaust flow be installed within one or more of the plurality of tubes of the housing.

10. The aftertreatment system of claim 8, wherein the controller adjusts a valve within at least one of the plurality of tubes to restrict the exhaust flow therethrough.

11. The aftertreatment system of claim 8, wherein the controller further determines based upon sensed data at least a pressure drop in the exhaust flow of the aftertreatment system or a soot loading of the plurality of treatment units and displays at least the pressure drop or the soot loading along with the display of the at least the desired number of the plurality of treatment units that should be utilized within the plurality of tubes of the housing.

12. The aftertreatment system of claim 11, wherein the controller includes stored data reflecting relationships between an orifice size the exhaust flow passes through and a combination of the $NO_2$ to $NO_x$ ratio, the filtration efficiency, the soot loading and the pressure drop.

13. The aftertreatment system of claim 8, wherein the plurality of treatment units are one of a diesel particle filters or a plurality of catalyst units.

14. A method of aftertreatment of exhaust from an engine, comprising:

receiving an exhaust flow from the engine into an apparatus that defines a multi-flow split arrangement;

passing the exhaust flow in parallel through the multi-flow split arrangement, wherein passing the exhaust flow in parallel through the multi-flow split arrangement includes treating the exhaust flow of less than all of the multi-flow split arrangement to define treated and untreated exhaust flow;

recombining the treated and untreated exhaust flow within the apparatus; and passing the recombined exhaust flow from the apparatus;

wherein treating the exhaust flow of less than all of the multi-flow split arrangement includes varying the number of one or more of a plurality of treatment units from the apparatus based upon determining a $NO_2$ to $NO_x$ ratio and a filtration efficiency and comparing the NO2 to NOx ratio and the filtration efficiency to governing regulatory standards.

15. The method of claim 14, wherein treating the exhaust flow of less than all of the multi-flow split arrangement includes leaving at least one of a plurality of tubes that define the multi-flow split arrangement empty or placing a restriction device within the at least one of the plurality of tubes to restrict the exhaust flow.

16. The method of claim 14, further comprising:

sensing a $NO_x$ concentration and a diesel particulate concentration in the exhaust flow;

determining a $NO_2$ to $NO_x$ ratio and a filtration efficiency; and comparing the NO2 to NOx ratio and the filtration efficiency to governing regulatory standards.

17. The method of claim 16, further comprising at least one of:

outputting a recommendation of at least a number of treatment units to install within the apparatus to treat the exhaust flow; or outputting a recommendation to install a restriction device along one or more of the multi-flow split arrangement and a recommendation of an orifice size for the restriction device.

18. The method of claim 17, further comprising:

determining based upon sensed data at least a pressure drop in the exhaust flow or a soot loading of the number of the treatment units; and outputting at least the pressure drop or the soot loading along with the outputting of the recommendation of at least the number of treatment units to install or the recommendation to install the restriction device.

19. The method of claim 14, further comprising adjusting a valve within at least one of the multi-flow split arrangement to restrict the exhaust flow therethrough.

20. The method of claim 14, wherein passing the exhaust flow in parallel through the multi-flow split arrangement further includes passing the untreated exhaust flow through a restriction device that defines an orifice that is configured to restrict the exhaust flow through the at least one of the plurality of tubes.

21. The method of claim 20, wherein the restriction device defines a fixed orifice that is configured to restrict the exhaust flow through the at least one of the plurality of tubes.

22. The method of claim 20, wherein the restriction device defines a valve that is configured to restrict the exhaust flow through the at least one of the plurality of tubes.

* * * * *